US011564448B2

(12) United States Patent
Engel

(10) Patent No.: US 11,564,448 B2
(45) Date of Patent: Jan. 31, 2023

(54) REFLECTIVE TEXTILE

(71) Applicant: Converse Inc., Boston, MA (US)

(72) Inventor: Gavin Engel, Somerville, MA (US)

(73) Assignee: Converse Inc., Boston, MA (US)

( * ) Notice: Subject to any disclaimer, the term of this patent is extended or adjusted under 35 U.S.C. 154(b) by 440 days.

(21) Appl. No.: 16/409,497

(22) Filed: May 10, 2019

(65) Prior Publication Data

US 2020/0352280 A1 Nov. 12, 2020

(51) Int. Cl.

| | |
|---|---|
| ***A43B 23/02*** | (2006.01) |
| ***A43B 1/14*** | (2006.01) |
| ***D04H 1/492*** | (2012.01) |
| ***D04H 1/498*** | (2012.01) |
| ***D06N 3/00*** | (2006.01) |

(52) U.S. Cl.

CPC ..... *A43B 23/0205* (2013.01); *A43B 1/14* (2013.01); *A43B 23/026* (2013.01); *A43B 23/0245* (2013.01); *D04H 1/492* (2013.01); *D04H 1/498* (2013.01); *D06N 3/0011* (2013.01); *D06N 2209/0876* (2013.01)

(58) Field of Classification Search

CPC ..... A43B 23/0205; A43B 23/0245; A43B 23/026; D04H 1/492; D04H 1/498; D06N 3/0011

USPC ..... 442/131

See application file for complete search history.

(56) References Cited

U.S. PATENT DOCUMENTS

| | | | |
|---|---|---|---|
| 3,288,579 | A | 11/1966 | Coates et al. |
| 3,400,188 | A | 9/1968 | Olson |
| 3,415,713 | A | 12/1968 | Smith |
| 4,197,343 | A | 4/1980 | Forsythe |
| 4,433,019 | A | 2/1984 | Chumbley |
| 4,569,874 | A | 2/1986 | Kuznetz |
| 5,910,225 | A | 6/1999 | McAmish et al. |
| 6,110,558 | A | 8/2000 | Britton et al. |
| 6,180,545 | B1 | 1/2001 | Okeya et al. |
| 6,671,936 | B1 | 1/2004 | Carlson et al. |
| 6,886,949 | B2 | 5/2005 | Tanaka |
| 7,497,978 | B2 | 3/2009 | Zafiroglu |
| 8,282,877 | B2 | 10/2012 | White et al. |

(Continued)

FOREIGN PATENT DOCUMENTS

| | | | |
|---|---|---|---|
| CN | 101952498 | A | 1/2011 |
| EP | 2077939 | B1 | 5/2012 |

(Continued)

OTHER PUBLICATIONS

International Search Report and Written Opinion received for PCT Patent Application No. PCT/US2020/030437, dated Aug. 6, 2020, 14 pages.

Mosberger, R., et al., "Multihuman tracking using high-visibility clothing for industrial safety," International Conference on Intelligent Robots and Systems, Nov. 3-7, 2013. http://aass.oru.se/Research/MRO/publications/2013/Mosberger_etal_2013-IROS-Multi-Human_Tracking_using_High-visibility_Clothing_For_Industrial_Safety.pdf.

(Continued)

*Primary Examiner* — Vincent Tatesure

(74) *Attorney, Agent, or Firm* — Shook Hardy & Bacon, LLP

(57) ABSTRACT

Aspects herein are directed to a reflective textile, and articles of apparel, uppers for an article of footwear constructed therefrom, comprising a reflective material dispersed between a first and second surface of the textile in a first zone. The first zone reflects a greater amount of light than a second zone of the textile. Other aspects herein are directed to a method of manufacturing a reflective textile or article having a portion comprising a reflective textile.

11 Claims, 8 Drawing Sheets

(56) References Cited

U.S. PATENT DOCUMENTS

| | | | | |
|---|---|---|---|---|
| 2004/0114353 | A1 | 6/2004 | Romeo | |
| 2005/0266755 | A1 | 12/2005 | Poirier | |
| 2008/0252976 | A1 | 10/2008 | Brennan | |
| 2014/0093707 | A1 | 4/2014 | Kaufmann | |
| 2015/0168614 | A1* | 6/2015 | Running | G02B 5/124 359/530 |
| 2016/0302507 | A1 | 10/2016 | Lewis et al. | |
| 2016/0332418 | A1 | 11/2016 | Jenkins et al. | |
| 2018/0361697 | A1 | 12/2018 | Krichevsky | |
| 2019/0099967 | A1 | 4/2019 | Bee et al. | |

FOREIGN PATENT DOCUMENTS

| | | | |
|---|---|---|---|
| FR | 2625017 | A1 | 6/1989 |
| GB | 2172546 | A | 9/1986 |

OTHER PUBLICATIONS

Wood, J.M., et al., "Drivers' and cyclists' experiences of sharing the road: Incidents, attitudes and perceptions of visibility," Accident Analysis & Prevention (Jul. 2009) 41(4):772776. http://eprints.qut.edu.au/29579/1/29579.pdf.

Wood, J.M., et al., "Using reflective clothing to enhance the conspicuity of bicyclists at night," Accident Analysis & Prevention (Mar. 2012) 45:726-730. http://eprints.qut.edu.au/47281/1/CyclistsAAPacceptedversion.pdf.

International Preliminary Report on Patentability received for PCT Patent Application No. PCT/US2020/030437, dated Nov. 25, 2021, 9 pages.

* cited by examiner

REFLECTIVE TEXTILE

TECHNICAL FIELD

This disclosure relates to textiles embedded with a reflective material and articles made therefrom.

BACKGROUND

Reflective textiles often include a reflective material disposed on a surface. For example, the reflective material may be chemically bonded (e.g., using an adhesive) or mechanically fixed (e.g., using stitching) to the surface. In some instances, surface-adorned reflective material may be susceptible to wear and degradation and are often still viewable in a non-reflective state.

BRIEF DESCRIPTION OF THE DRAWINGS

Examples of aspects of this disclosure are described in detail below with reference to the attached drawing figures, which are incorporated herein by reference.

DETAILED DESCRIPTION

Figure 1:
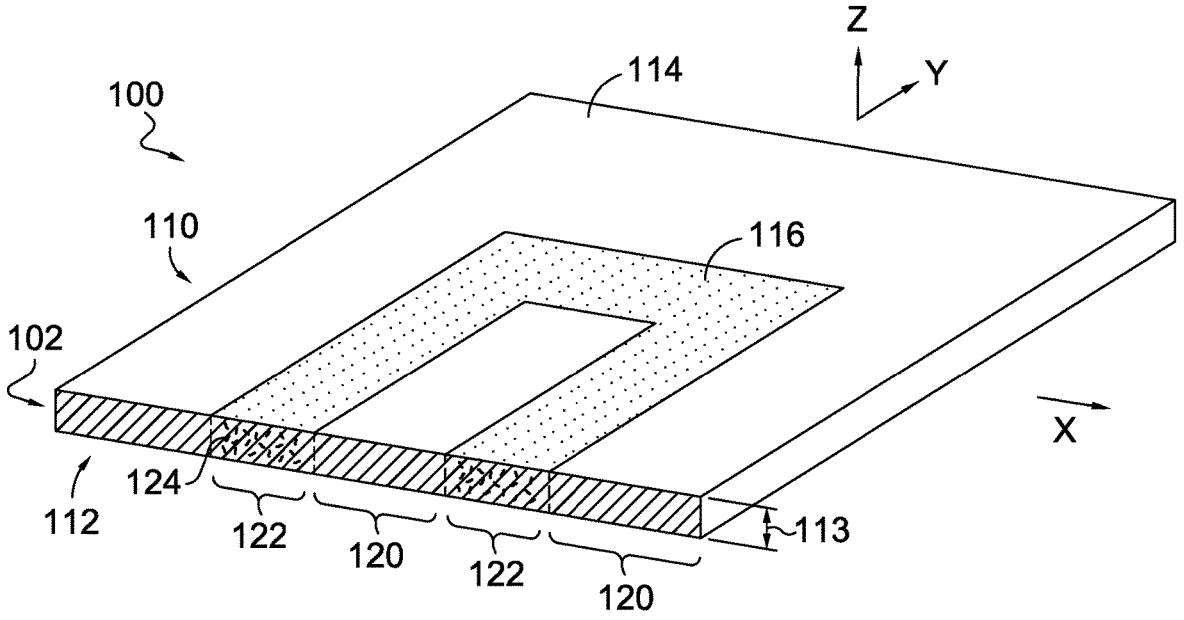
FIG. 1 depicts a perspective view of an exemplary textile having a reflective material embedded in portions of the textile in accordance with an aspect of this disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

Traditionally, reflective textiles often include a reflective material disposed on a surface. For example, the reflective material may be chemically bonded (e.g., using an adhesive) or mechanically fixed (e.g., using stitching) to the surface. One issue sometimes faced by these textiles is the susceptibility of the reflective material to separate from the surface or degrade through use and care. Furthermore, in some instances it can be challenging to create a textile with multiple zones having varied respective degrees of reflectivity. Moreover, when reflective material is deposited on a surface, the reflective material may still be undesirably viewable in a non-reflective state.

At a high level, the subject matter described in this Specification generally relates to, among other things, a textile having embedded reflective material, articles constructed at least partially from such a textile, and methods of making any of the foregoing, and any combination thereof. The reflective textile includes a textile layer having a first surface, a second surface, and a fiber matrix extending between the first and second surfaces. At least a portion of the textile includes a reflective material embedded between the first surface and the second surface and among the fiber matrix. In some aspects, the embedded reflective material may more wear resistant than a surface-deposited reflective material. In addition, the embedded reflective material may provide at least some customization of the amount of reflectively constructed into a textile. Furthermore, the embedded reflective material may be less viewable in a non-reflective state, as compared with a surface deposited reflective material.

As used herein, a "reflective material" may be a material having any one or more reflective characteristics, including, without limitation, retroreflectivity, specular reflectivity, and diffuse reflectivity. For the purposes of this Specification, "retroreflective" is used to describe a phenomenon wherein a reflected ray travels along a vector parallel to that of an incident ray (e.g., originating from a light-emitting source), but in the opposite direction. In other words, a material is retroreflective when it reflects light back at its source. Some examples of retroreflective materials include tapes, sheets, strips, and the like, comprising reflective glass beads, microprisms, lenses, or the like. The term "specular reflectivity" is used to describe a condition where a reflected ray is reflected at an angle away from an emitting light source. The reflected ray may be said to have an angle of reflection relative to a plane normal to the reflecting surface, the angle of reflection being equal to an angle of incidence relative to the normal plane. One common example of a specular reflective material is a mirror; other examples may include metallic substances, particularly those with a microscopically smooth surface and/or lustrous appearance, such as aluminum foil. A material may be said to have diffuse reflectivity when at least some of the light incident to a rough surface is reflected in many directions. Most materials are diffuse reflectors. Examples of materials having diffuse reflective properties are unadorned textiles, including non-woven textiles, such as felt, woven textiles, knit textiles, braided textiles, and the like. A diffuse reflecting material may have a particular color, in which case all portions of the visible light spectrum (electromagnetic waves having a wavelength in the range of 380 nm-750 nm) are absorbed by said material except for the particular color, which is diffusely reflected in many directions due to the material's uneven surface. For the sake of simplifying the numerous variations that may occur, certain figures, such as FIGS. 3A-3C, generally depict a material as diffusely reflecting incident light. No limitation should be inferred by any indication of a quantity of incident light that is diffusely reflected; that is, the surface could be white, wherein light is reflected across the visible light spectrum, a particular color, wherein only a portion of the visible spectrum is reflected, or black, wherein no particular portion of the visible spectrum is reflected.

As used throughout this disclosure, the term "reflective," when used to describe a material or property, may refer to either relative reflectivity or absolute reflectivity. By saying that a first material or first zone is reflective may be understood to mean that the first material or first zone has a higher reflectivity relative to a second material or second zone. In one example, where a retroreflective material is adorned to a textile layer, the textile layer would be considered non-reflective and the retroreflective material considered reflective due to the amount of reflected light being observed at a particular point being greater for the retroreflective material than the textile itself. Relative reflectivity may be human-perceptible; that is, a human viewer may readily determine which surface is reflective and which is non-reflective when exposed to a light source having one or more wavelengths in the visible portion of the electromagnetic spectrum (i.e., 380 nm-750 nm). For example, with respect to a retroreflective material, when a viewer is within a certain observation angle (e.g., 1 degree) of an emitting light source (e.g., a white light having a plurality of wavelengths found within a range extending from 380 nm to 750 nm), and the incident ray strikes the observed surface within a certain entrance angle (e.g., 45 degrees) relative to the surface's normal axis, the reflective material may reflect considerably more light to the observation point than the textile, of itself. In another example, if the reflective material had spectrally reflective properties, an observation point at an angle of reflection equal to the angle of incidence may experience a considerable amount of reflected light from the reflective material, particularly compared to the relatively non-reflective textile.

Additionally or alternatively to human perception, "reflective" may be understood to mean that the first material of first zone exceeds a threshold of absolute reflectivity. Absolute reflectivity may be measured using devices that measure an amount of reflected light, such as spectrophotometers, spectrometers, luxometers, or any other instrument suitable for detecting an amount/intensity of reflected waves at a one or more wavelengths. Various standards and methodologies may be used to determine absolute reflectivity.

As used herein, terms such as "reflectance," "reflectivity," "light reflectance value," may be considered to be synonymous and mean the quotient of the amount of light reflected by a material divided by the amount of light received by the material, determined using the testing procedures set forth in ASTM E1331-15. A material may be considered reflective if it has a reflectivity greater than or equal to a threshold and considered non-reflective if it has a reflectivity less than the threshold. In aspects, said threshold may be 0.5 (50%), 0.25 (25%), 0.75 (75%), or any desirable threshold between 0.1 (10%) and 0.9 (90%).

A "coefficient of retroreflection" is another type of standard-based measurement and is used to specifically quantify a material's retroreflectivity. For the purpose of specifically defining retroreflectivity in this specification, a "coefficient of retroreflection" or "$R_A$" may be said to be the candela/lux/$m^2$ for a particular entrance angle and observation angle, determined in accordance with the testing, measurement, and analytical procedures defined by the "Ratio Method" of ASTM E809-08. A material may be termed to be "retroreflective" or "reflective" for the purposes of this specification if a material has an $R_A$ greater than or equal to a threshold and considered non-reflective if it has a reflectivity less than the threshold. In aspects, said threshold may be 25, when measured in dry conditions at a five degree entrance angle and 0.2 degree observation angle. In other aspects, said threshold may be 5, 50, or 100, when measured under the same conditions.

In one aspect of this disclosure, FIG. 1 depicts a reflective textile 100, including a textile layer 102 embedded with a reflective material 124. The textile layer may comprise a variety of different types of textiles that are constructed of fibers or threads co-mingled to form a sheet, such as a woven textile, non-woven textile, knit textile, braided textile, and the like. The fibers or threads may be synthetic, natural, and any and all combinations thereof. In aspects of this disclosure, the structure of the combined fibers and threads (e.g., co-mingling, entangling, intertwining, knitting, weaving, braiding, twisting, and the like) permit the reflective material 124 to be embedded therein, such as by transferring (e.g., needle punching, massaging, water jetting, etc.) the reflective material 124 into a thickness of the textile layer 102, and thereby trapping segments of the reflective material 124 among the fibers and threads. One example of a non-woven construction is a felt. The felt may comprise natural fibers, synthetic fibers, or a combination of natural and synthetic fibers. In other aspects, the textile layer 102 may comprise a woven construction. In yet other aspects, the various disclosed textiles may be a knit construction (e.g., a single knit or double knit), or any other construction capable of having a reflective material embedded therein. In some aspects, a textile in accordance with aspects herein may have a combination of woven portions, knit portions, and/or non-woven portions. A textile in accordance with aspects herein may comprise nylon yarns or polyester yarns. In exemplary aspects, the nylon or polyester yarns may comprise less textured and/or flat yarns. Any and all aspects, and any combination and/or variation thereof, is contemplated as being within aspects herein.

In FIG. 1 the textile layer 102 includes a first surface 110, a second surface 112, and a fiber matrix extending between the first and second surfaces. The textile layer 102 may have a thickness in the range of 0.5 mm-10 mm, for example, it may have a thickness of 6 mm, ±10%, as measured from the first surface 110 to the second surface 112. The reflective textile 100 comprises a first portion 114 of the first surface 110 and a second portion 116 of the first surface 110. The first portion 114 may correlate with a first zone 120 and the second portion 116 may correlate with a second zone 122. The reflective textile 100 comprises a reflective material 124 disposed between first surface 110 and the second surface 112 in the second zone 122. In some aspects, the reflective textile 100 does not comprise the reflective material 124 in the first zone 120. In other aspects, the first zone 120 may comprise the reflective material 124, wherein the amount of the reflective material 124 in the second zone may be 125%, 150%, 175%, or two or more times more dense than the amount in the first zone 120.

In some aspects, a first amount or quantity of the reflective material 124 is disposed as a plurality of fragments between the first surface 110 and the second surface 112 in the second zone 122 of the textile layer 102. The plurality of fragments may have a variety of different shapes and sizes depending on the manner in which the fragments are dispersed among the fiber or thread matrix. For example, in some instances the reflective material 124 may be initially applied to the first surface 110, and subsequently driven into the textile layer 102 between the first and second surfaces. Some embedding techniques may cause asymmetrical fragments to break away from the first surface 110 and embed among the fiber or thread matrix. As used herein, "asymmetrical" describes an asymmetry of a single fragment or an asymmetry from one fragment to the next. In contrast, other techniques may create fragments that are relatively uniform in one or more respects to become embedded in the textile 100. In a further aspect, a second quantity or portion of the reflective material 124 is disposed directly on the first surface 110 (e.g., in the second portion 116). For example, the second portion of the reflective material 124 may remain as a deposit on the first surface 110 after the first amount or quantity of the reflective material 124 has been embedded in the textile layer 102.

The relative amounts of the reflective material 124 in the first quantity, which is embedded in the textile layer 102, as compared with the second quantity disposed on the first surface 110 may vary depending on various factors. For example, rendering the reflective material 124 wear resistant by embedding the first quantity may be balanced with achieving reflectivity from the surface-disposed, second quantity of the reflective material. As such, the embedded first amount of the reflective material 124 may be a larger quantity than the surface-disposed second amount. In another aspect, the embedded first amount of the reflective material 124 may be relatively similar to the surface-disposed second amount. In yet another aspect, the embedded first amount of the reflective material 124 may be less than the surface-disposed second amount.

The reflective material 124 may be any suitably reflective material with respect to wavelengths of light within the visible light spectrum (approximately 350 nm-750 nm). In some aspects, the reflective material may be retroreflective, specularly reflective, and/or diffusely reflective. For example, the reflective material 124 may comprise a reflective thermoplastic polyurethane (TPU) film. In other aspects, the reflective material 124 may be a portion of a reflective tape or sheet, such as 3M™ Scotchlite™. In yet other aspects, the reflective material may be any one or more materials having high reflectively in portions of the electromagnetic spectrum comprising visible light. Non-limiting examples of such a material may include, liquid, aqueous, vaporized, or powdered metals such as aluminum (Al), zinc (Zn), nickel (Ni), copper (Cu), silver (Ag), tin (Sn), cobalt (Co), manganese (Mn), iron (Fe), magnesium (Mg), lead (Pb), chromium (Cr), and/or alloys thereof. Further, exemplary reflective materials may comprise non-metallic substances or compounds comprising metals such as metalized biaxially-oriented polyethylene terephthalate (BoPET), commonly known by the trade name Mylar®, Melinex®, and Hostaphan®, and metalized polyethylene terephthalate (PET). Other exemplary reflective materials may comprise semi-metallic substances such as silicon (Si) and silicon containing compounds. Further, though the reflective material 124 is shown as a plurality of continuous strands in FIG. 1, when embedded within the textile layer 102, the reflective material 124 may be in the form of asymmetric fragments of various sizes, shapes, and densities.

The reflective material may have various levels of reflectivity, depending on the zone. In any one or more aspects as defined herein, the first zone 120 may be considered to be non-reflective and the second zone 122 may be considered to be reflective (i.e., relative to one another). Specifically, the reflective material 124 disposed in the second zone 122 may cause the second portion 116 of the first surface 110 to have a retroreflectivty that exceeds a threshold. Because textiles such as the textile layer 102 have uneven surfaces, and because there may be less or no reflective material 124 disposed thereunder, the first portion 114 of the first surface 110 may diffusely reflect light, resulting in a retroreflectivity less than a threshold. In aspects, the second portion 116 of the first surface 110 may be U-shaped, as depicted in FIG. 1. In other aspects, the second portion 116 of the first surface 110 may be any geometric shape or be shaped to resemble or represent a logo, brand, emblem, and the like.

In some aspects, the reflective textile 100 may comprise a plurality of zones with varying levels of reflectivity or retroreflectivity. For example, the first portion 114 of the first surface 110 may be non-reflective based on having a first coefficient of retroreflectivity below a threshold, the second portion 116 of the first surface 110 may be reflective based on having a second coefficient of retroreflectivity that exceeds the threshold, and a third portion of the first surface 110 may also be reflective based on having a third coefficient of retroreflectivity that exceeds the threshold. In aspects, the third coefficient of retroreflectivity may be greater than the second coefficient of retroreflectivity, causing the third portion of the first surface 110 to be relatively and absolutely more reflective than both the first portion 114 and the second portion 116 of the first surface 110. These gradients of reflectivity may be particularly useful when creating reflective shapes that resemble logos, brands, emblems, and the like. As will be discussed in greater detail herein, the coefficient of reflectivity can be changed by adjusting the density of the reflective material 124 disposed within the textile layer 102, and/or by adjusting the distance between the reflective material 124 and the first surface 110 (greater distances may attenuate retroreflectivity).

Figure 2:
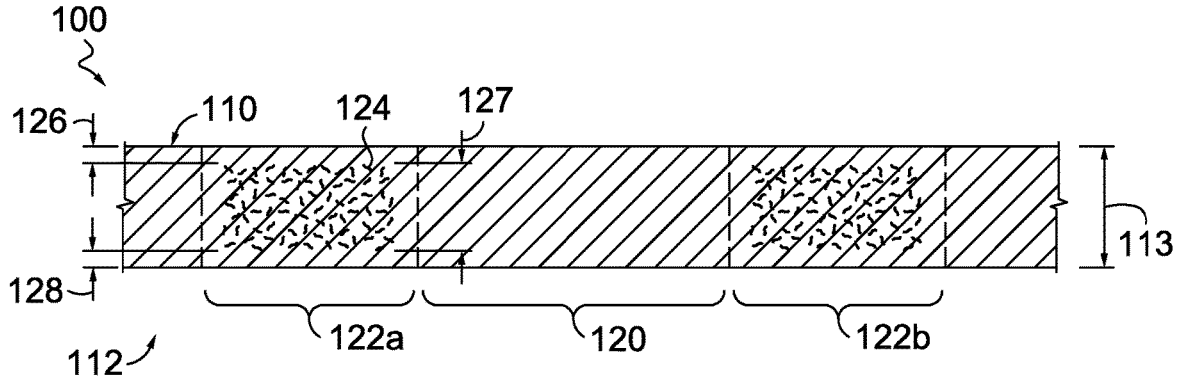
FIG. 2 depicts a cross-sectional view depicting a textile having a reflective material embedded in portions of the textile in accordance with an aspect of this disclosure.

Turning now to FIG. 2, a cross-sectional view of the reflective textile 100 of FIG. 1 is illustrated in accordance with aspects of this disclosure. The reflective material 124 is embedded in reflective textile 100 as a reflective-material stratum having a stratum thickness 127, which includes the average distance from a first depth 126 to a second depth 128 across an area (e.g., 1 $cm^2$). The first depth may be said to be the perpendicular distance between the first surface 110 and the shallowest occurrence of embedded reflective material 124 (in which case "shallowest" is with reference to the first surface 110). The second depth 128 may be said to be the perpendicular distance between the second surface 112 and the deepest occurrence of embedded reflective material 124 (in which case "deepest" is with reference to the first surface 110). The textile layer 102 has a thickness 113, wherein the thickness 113 is the perpendicular distance between the first surface 110 and the second surface 112. In aspects, the sum of the first depth 126, the second depth 128, and the stratum thickness 127, across an area, is equal to the thickness 113. As used herein, each of the first depth 126, the second depth 128, and the stratum thickness 127 may be expressed as a percentage of the thickness 113 (e.g., 10%) or as a measured distance (e.g., 1 mm).

Figure 3A:
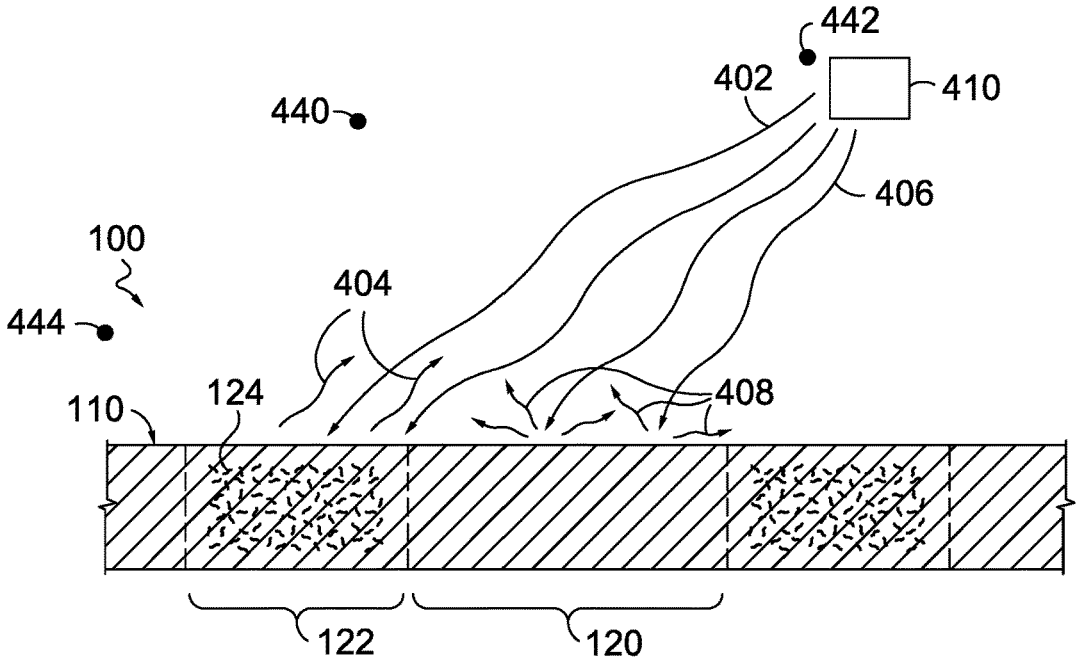
FIGS. 3A-3C depict cross-sectional views of the textile of FIG. 1 in different lighting conditions, in accordance with an aspect of this disclosure.
Figure 3B:
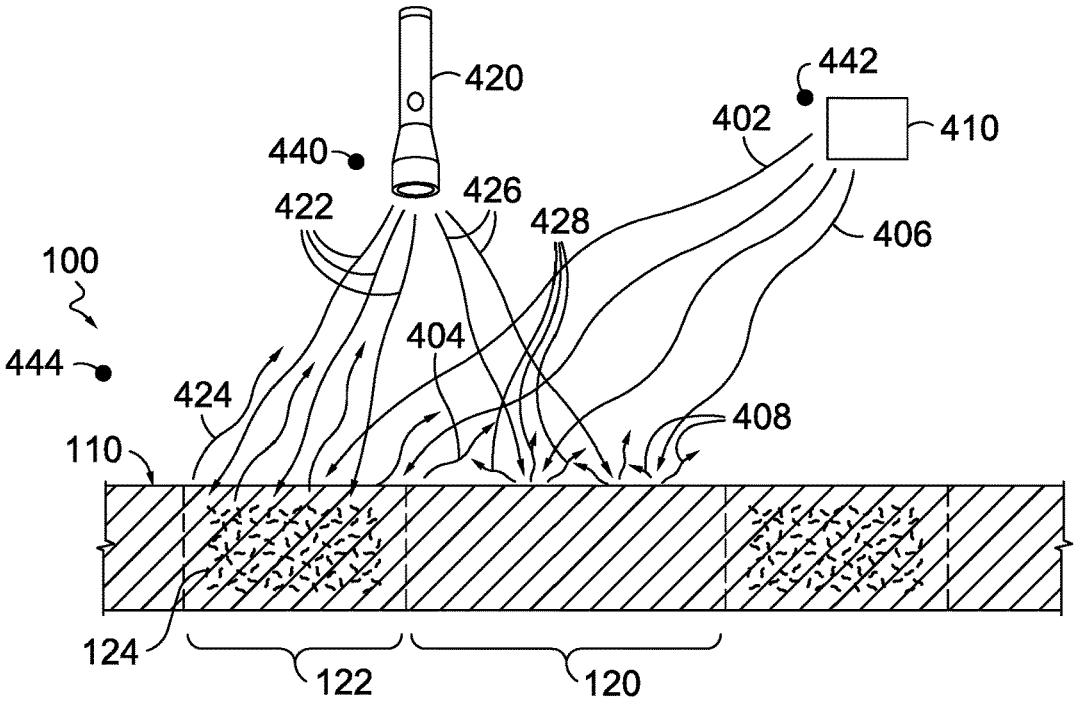
Figure 3C:
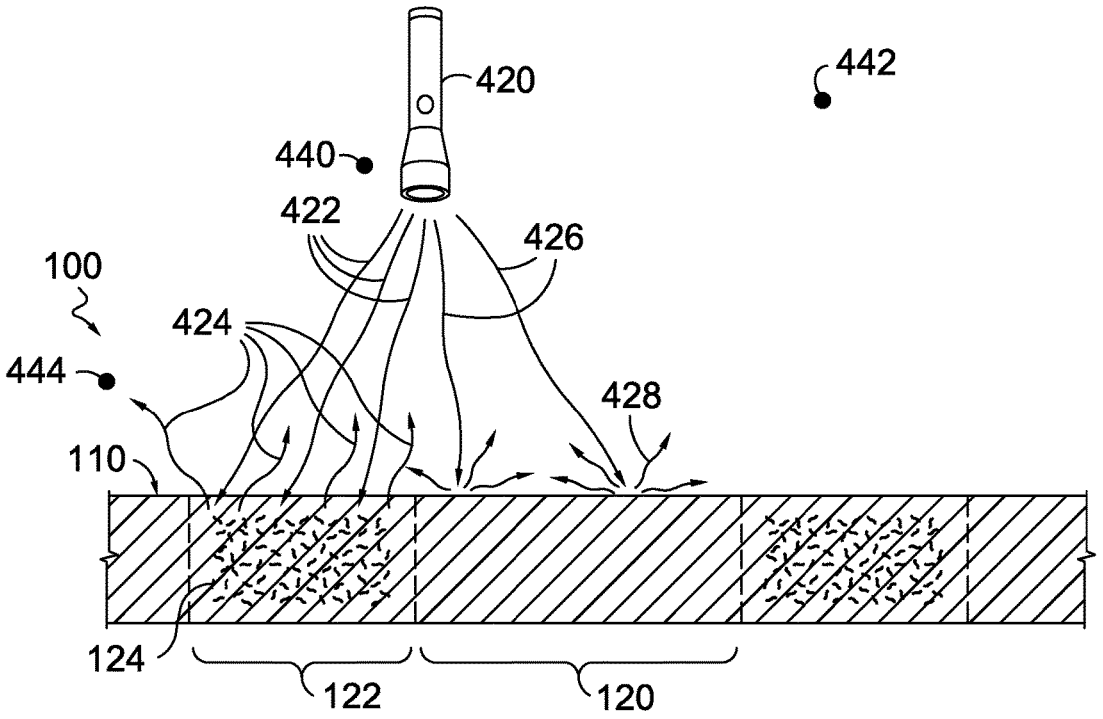

Referring to FIGS. 3A-3C, cross sectional views of the reflective textile 100 of FIG. 1 are shown exposed to various light sources in order to illustrate one or more mechanisms by which the textile 100 might reflect light in accordance with some aspects of this disclosure. FIGS. 3A, 3B, and 3C all include the same textile 100 and common observation points, and in each figure, the respective light source(s) are modified in order to help illustrate a reflective mechanism. For example, each of FIGS. 3A-3C depict a first observation point 440, a second observation point 442, and a third observation point 444. The first observation point 440 is located near a plane that is perpendicular to the first surface 110 and proximate to a boundary between the first zone 120 and the second zone 122. The second observation point 442 is located near the first light source 410. The third observation point 444 is located further from the second observation point 442 than the first observation point 440. With respect to light sources, FIGS. 3A and 3B both include a first light source 410, and FIGS. 3B and 3C both include a second light source 420.

The first light source 410 may be said to emit a first incident ray 402 towards the second zone 122 and a second incident ray 406 towards the first zone 120. The first light source may be a natural light source (e.g., sunlight) or artificial (e.g., a lamp). As disclosed herein, the first zone may comprise no reflective material 124, a lower density of reflective material 124 than the second zone 122, or the reflective material 124 may be disposed at a greater distance (e.g., 126) from the first surface 110 in the first zone 120, relative to the second zone 122. The second incident ray 406 diffuses into one or more diffuse reflections 408 upon striking the irregular surface of the textile layer 102. Accordingly, approximately the same amount of diffuse reflections 408 will be received at each of the first observation point 440, the second observation point 442, and the third observation point 444. The result is that the first zone will be a non-reflective, humanly-perceptible color (e.g., if the first surface 110 is red, light waves in the red portion of the visible spectrum (i.e., electromagnetic radiation having one or more wavelengths found within the range of 650 nm-750 nm) will be reflected and perceivable). In contrast, at least a portion of the first incident ray 402 may penetrate the first surface 110 and reflect off the embedded reflective material 124 to create one or more reflected rays 404.

Though the second zone 122 would thus be considered reflective as defined herein, depending on the composition, the one or more reflected rays 404 may result in various perceived effects at the various observation points. For example, FIG. 3A depicts a retroreflective effect. The one or more reflected rays 404 are reflected parallel to, and in the opposite direction of the first incident ray 402. Accordingly, when observed from the first observation point 440 and the third observation point 444, the second zone 122 may not appear to be particularly reflective; however, when observed from the second observation point 442, the second zone 122 may appear reflective, relative to the first zone 120. Though in such an example, the relative reflectivity at the first observation point 440 and the second observation point 442 may be lower, the absolute reflectivity, as measured using total reflectance or coefficient of retroreflectivity would exceed the reflective/non-reflective threshold.

In another aspect, the composition of the reflective material 124 may have specularly reflective properties. In such an aspect, the first incident ray 402 may be reflected, by the second zone 122, primarily towards the third observation point 444, resulting in high relative reflectivity. When observed from the first observation point 440 and the second observation point 442, the second zone 122 may not appear to be relatively reflective. The composition of the reflective material 124 may alternatively have diffuse reflective properties. In that aspect, the first incident ray 402 may be diffusely reflected by the second zone 122 similar to the one or more diffuse reflections 408 caused by the first zone 120. However, the reflective material may reflect a greater amount of the first incident ray 402. Accordingly, each of the first observation point 440, the second observation point 442, and the third observation point 444 would perceive that the second zone was relatively reflective. It should be noted that regardless of whether the reflective material 124 causes the first incident ray 402 to reflect retroreflectively, specularly, or diffusely, the absolute reflectivity of the second zone 122 is greater than the absolute reflectivity of the first zone 120 within the visible light spectrum—the particular reflective characteristic may only change where the one or more reflected rays 404 are perceived.

Turning now to FIGS. 3B and 3C, a second light source 420 emits a plurality of incident rays towards the first surface 110. For the purpose of simplicity, it is expressly conceived that the phenomenon discussed above with respect to diffuse and specular reflection may be considered to exist in response to one or more of a third incident ray 422 striking the first surface 110 of the second zone 122. However, only retroreflective effect will be discussed in detail with respect to the second light source 420. Referring to FIG. 3B, the reflective textile 100 may be exposed to the second light source 420 in addition to the first light source 410. Though depicted as a flashlight, the second light source 420 may be any natural or artificial light source. In a particular example, the first light source 410 may be a setting sun and the second light source 420 may be a vehicle headlight.

The second light source 420 emits one or more of the third incident rays 422 towards the second zone 122 and emits one or more of a fourth incident ray 426 towards the first zone 120. A second reflected ray 424 results from the reflection of the one or more third incident rays 422 by the reflective material 124 embedded in the second zone 122. A second amount of diffuse reflections 428 results from the reflection of the one or more fourth incident rays 426 by the first surface 110 of the first zone 120. From the standpoint of absolute reflectivity, the second zone 122 has a higher total reflectance than the first zone 120. In the instance where the reflective material 124 has retroreflective properties, the coefficient of retro reflectivity for the second zone 122 is greater than the coefficient of retro reflectivity for the first on 120. From the standpoint of relative reflectivity, the first observation point 440 will perceive significant reflections from the second zone 122 due to the second reflected rays 424 being reflected back towards the second light source 420. The first observation point may not observe particular reflectivity from the first zone 120 because only a portion of the second diffuse reflections 428 are reaching the first observation point 440. At the second observation point 442, the first reflected rays 400 for continue to be reflected by the reflective material 124 and the second zone 122. The second observation point 442 may not perceive the second reflective ray 424 because of the large observation angle between the second observation point 442 and the second light source 420. The third observation point 444 may not perceive particular relative reflectivity of the second zone 122 if the reflective material possesses retroreflective properties due to the second reflected rays 424 being reflected away from the third observation point 444 and towards the second light source 420 while the first reflected rays 404 are reflected back towards the first light source 410.

Turning now to FIG. 3C, the reflective textile 100 may be exposed to the second light source 420 but not the first light source 410. The absence of the first light source 410 does not impact the ability of the second zone 122 to reflect one or more of the third incident rays 422; however, said absence may greatly reduce or eliminate the retroreflective effect perceived at the second observation point 442.

Figure 4:
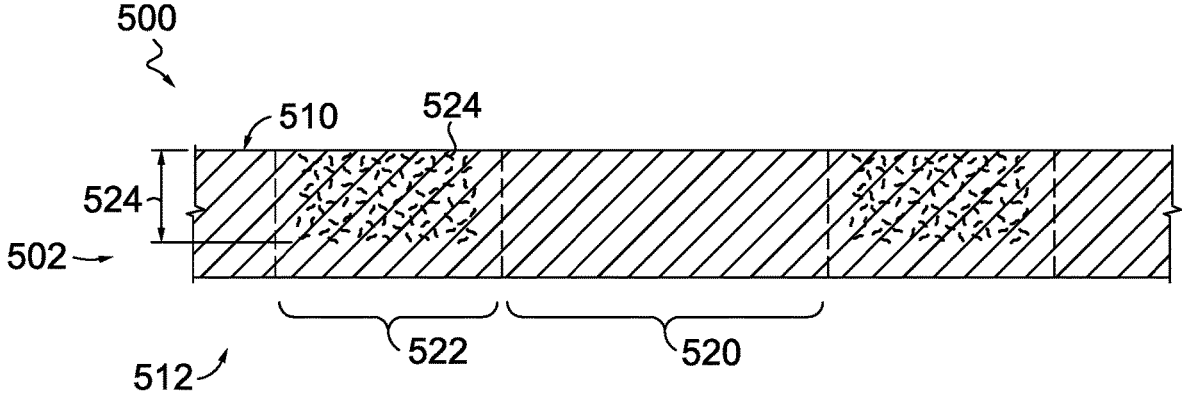
FIG. 4 depicts a cross-sectional view of textile having a reflective material embedded a depth in accordance with an aspect of this disclosure.

Referring to FIG. 4, a reflective textile 500 is illustrated in accordance with one aspect of this disclosure. The reflective textile 500 may have any one or more characteristics of the reflective textile 100 of FIGS. 1 and 3-3C. In particular, the reflective textile 500 may comprise a textile layer 502 having a first surface 510, a second surface 512, and a fiber matrix extending between the first and second surfaces. The reflective textile 500 may also comprise a first zone 520 with little or no reflective material 524 and a second zone 522 comprising reflective material 524. The reflective material 524 may be disposed within the second zone 522 of the textile layer 502 in a reflective-material stratum having a stratum thickness 525 beginning at the first surface 510 and extending towards the second surface 512. In aspects, the stratum thickness 525 may be any portion of 10%-50% of the thickness of the textile layer 502.

Figure 5:
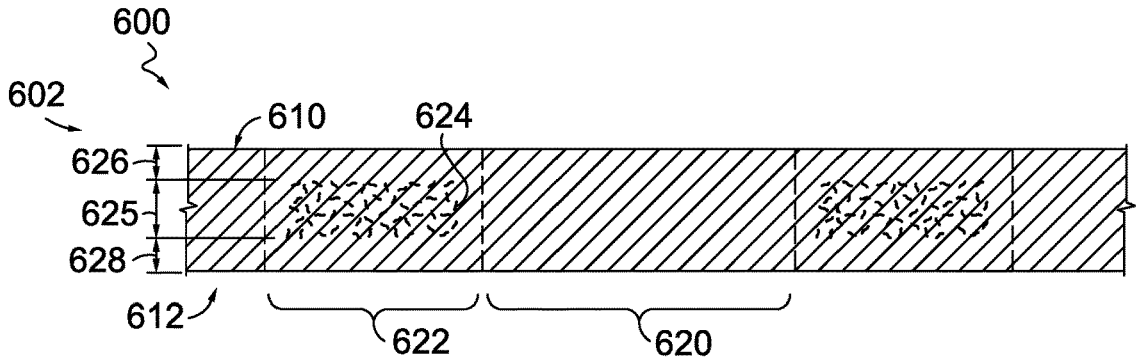
FIG. 5 depicts a cross-sectional view of a textile having a reflective material embedded within a range of positions between a first surface and a second surface of the textile in accordance with an aspect of this disclosure.

Referring to FIG. 5, a reflective textile 600 is illustrated in accordance with one aspect of this disclosure. The reflective textile 600 may have any one or more characteristics of the reflective textile 100 of FIGS. 1 and 3-3C. In particular, the reflective textile 600 may comprise a textile layer 602 having a first surface 610, a second surface 612, and a fiber matrix extending between the first and second surfaces. The reflective textile 600 may also comprise a first zone 620 with little or no reflective material 624 and a second zone 622 comprising the reflective material 624. The reflective material 624 may be disposed within the second zone 622 of textile layer 602 in a reflective-material stratum having a stratum thickness 625 beginning at a first depth 626 and extending towards the second surface 612 to a second depth 628, wherein the stratum thickness 625 is greater than 10% of the thickness of the textile layer 602. In aspects, the first depth 626 may be in a range of 1%-25% of the thickness of the textile layer 602, and the second depth 628 may be in a range of 1%-75% of the thickness of the textile layer 602.

Figure 6:
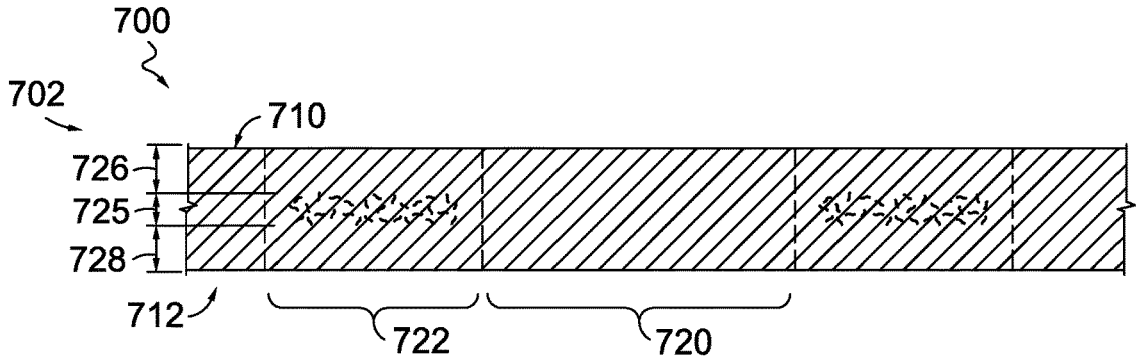
FIG. 6 depicts a cross-sectional view of a textile having a reflective material embedded within another range of positions between a first surface and a second surface of the textile in accordance with an aspect of this disclosure.

Referring to FIG. 6, a reflective textile 700 is illustrated in accordance with one aspect of this disclosure. The reflective textile 700 may have any one or more characteristics of the reflective textile 100 of FIGS. 1 and 3-3C. In particular, the reflective textile 700 may comprise a textile layer 702 having a first surface 710, a second surface 712, and a fiber matrix extending between the first and second surfaces. The reflective textile 700 may also comprise a first zone 720 with little or no reflective material 724 and a second zone 722 comprising the reflective material 724. The reflective material 724 may be disposed within the second zone 722 of the textile layer 602 in a reflective-material stratum having a stratum thickness 725 beginning at a first depth 726 and extending towards the second surface 712 to a second depth 728, wherein the stratum thickness 725 is less than or equal to 10% of the thickness of the textile layer 702. In aspects, the first depth 726 may be in a range of 1%-50% of the thickness of the textile layer 702, and the second depth 728 may be in a range of 1%-75% of the thickness of the textile layer 702.

Figure 7:
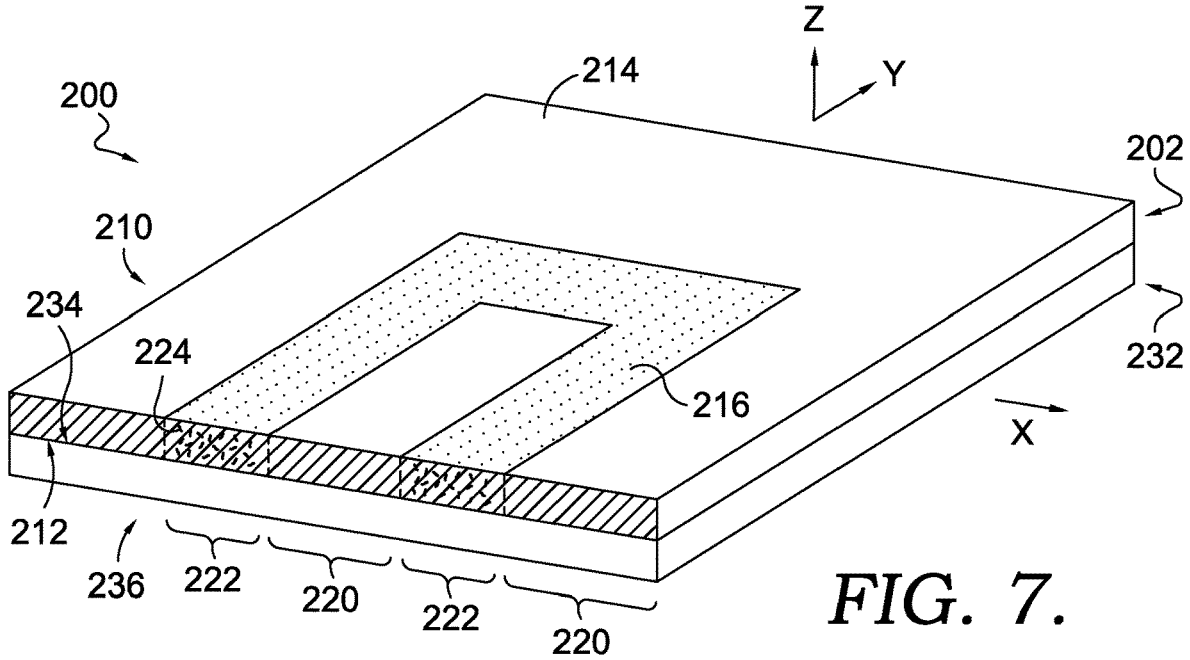
FIG. 7 depicts a perspective view of an exemplary layered textile having a reflective material embedded in portions of a first layer of the textile in accordance with an aspect of this disclosure.

Turning now to FIG. 7, a layered reflective textile 200 is illustrated in accordance with aspects of this disclosure. The reflective textile 200 comprises a first textile layer 202 and a second textile layer 232. The first textile layer comprises a first surface 210, a second surface 212, and a fiber matrix extending between the first and second surfaces. In aspects, the first textile layer 202 is the reflective textile 100, 500, 600, or 700 of FIGS. 1 and 3-7. That is, the first textile layer 202 may comprise a first portion 214 of the first surface 210 and a second portion 216 of the first surface 210. The first portion 214 of the first surface 210 may correlate to a first zone 220 and the second portion 216 of the first surface 210 may correlate to a second zone 222. The second zone 222 may comprise reflective material 224 disposed between the second portion 216 of the first surface 210 and the second surface 212. The first zone 220 may not comprise reflective material 224 or may comprise a lower density of reflective material 224 than the second zone 222.

The second textile layer 232 comprises a first surface 234, a second surface 236, and a fiber matrix extending between the first and second surfaces. In aspects, the second textile layer 232 may not comprise reflective material 224. In other aspects, the second textile layer 232 may comprise reflective material 224 at a lower density than that of the second zone 222 of the first textile layer 202. The first surface 234 of the second textile layer 232 may be coupled to the second surface 212 of the first textile layer 202. Said coupling may be accomplished using any suitable means, for example, they may be coupled using chemical means, such as adhesives or hotmelt, or using mechanical means, such as stitching or felting. The second textile layer 232 may comprise any one or more materials described with reference to the textile layer 102 of FIG. 1. In some aspects, the second textile layer 232 may be a non-textile matrix material that may provide structure to the first textile layer 102; in such aspects, the second textile layer 232 may comprise TPU, plastic, silicon, or the like.

Aspects of this disclosure contemplate incorporating any one or more of the textiles described herein, such as the reflective textile 100, reflective textile 200, reflective textile 500, reflective textile 600, or reflective textile 700 in an article, such as a garment, accessory, or shoe upper. With respect to the articles of FIGS. 8-12, it is contemplated that the article, being comprised of the reflective textile 100, reflective textile 200, reflective textile 500, reflective textile 600, or reflective textile 700, has a first surface 110, 210, 510, 610, 710. The first surface may comprise an outer-facing surface of the article; that is, the first surface may face away from a wearer when the article is worn in an as-intended manner. FIGS. 8-12 illustrate exemplary articles in accordance with aspects of this disclosure.

Figure 8:
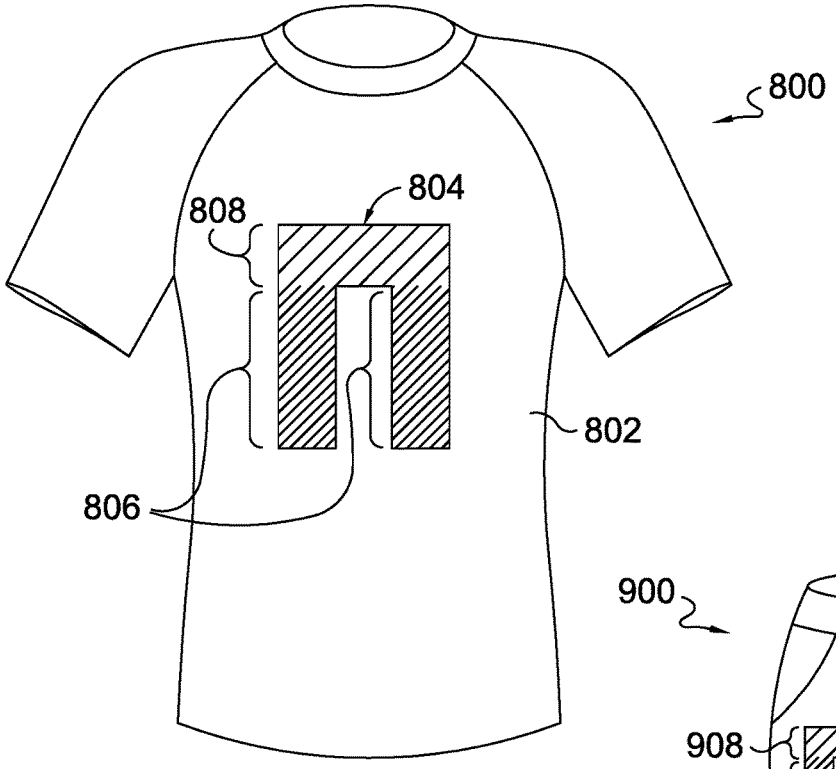
FIGS. 8-12 each depict a respective article having a reflective portion in accordance with aspects of this disclosure.

Turning now to FIG. 8, an upper body garment 800 is illustrated in accordance with aspects of this disclosure, such as a shirt, or outerwear. The upper body garment 800 may be at least partially constructed with a reflective textile in accordance with one or more aspects described herein. The upper body garment 800 may comprise a nonreflective portion 802 and a reflective portion 804. The reflective portion 804 may have a single level of reflectivity (not explicitly depicted in FIG. 8 but still expressly described in other portions of this disclosure), or may have various levels of reflectivity 806 and 808, such as shown in FIG. 8. For example, the reflective portion 804 may comprise a high reflective zone 806 and a low reflective zone 808, wherein the low reflective zone 808 has a lower total reflectivity or coefficient of retroreflectivity than the high reflective zone 806. Varied levels of reflectivity might result from various constructions. For example, a larger amount of reflective material may be applied to the surface of the garment 800 in the high reflective zone 806 (as compared with the low reflective zone 808); a larger amount of reflective material may be embedded in the high reflective zone 806; or any and all combinations thereof. Additionally or alternatively, this may be the result of the reflective material being disposed at a depth, such as the first depth 626 of FIG. 5 from the first surface 610, greater in the low reflective zone 808 than in the high reflective zone 806. This may also be the result of using a first reflective material in the high reflective zone 806 and a second reflective material in the low reflective zone 808, wherein the second reflective material has a lower reflectivity and or coefficient of retro reflectivity than the first reflective material.

Figure 9:
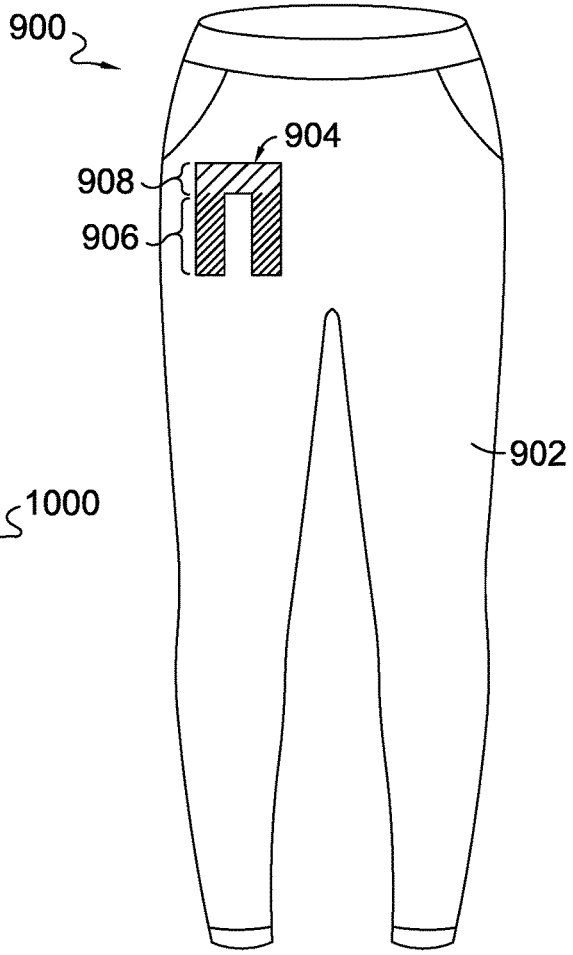

Turning now to FIG. 9, a lower body garment 900 is illustrated in accordance with aspects of this disclosure, such as pants or shorts. The lower body garment 900 may be at least partially constructed with a reflective textile in accordance with one or more aspects described herein. The lower body garment 900 may comprise a nonreflective portion 902 and a reflective portion 904. The reflective portion 904 may have a single level of reflectivity (not explicitly depicted in FIG. 9 but still expressly described in other portions of this disclosure), or may have various levels of reflectivity, such as shown in FIG. 9. For example, the reflective portion 904 may comprise a high reflective zone 906 and a low reflective zone 908, wherein the low reflective zone 908 has a lower total reflectivity or coefficient of retroreflectivity than the high reflective zone 906. Varied levels of reflectivity might result from various constructions. For example, a larger amount of reflective material may be applied to the surface of the garment 900 in the high reflective zone 906 (as compared with the low reflective zone 908); a larger amount of reflective material may be embedded in the high reflective zone 906; or any and all combinations thereof. Additionally or alternatively, this may be the result of the reflective material being disposed at a depth, such as the first depth 626 of FIG. 5 from the first surface 610, greater in the low reflective zone 908 than in the high reflective zone 906. This may also be the result of using a first reflective material and the high reflective zone 906 and a second reflective material in the low reflective zone 908, wherein the second reflective material has a lower reflectivity and or coefficient of retro reflectivity than the first reflective material.

Figure 10:
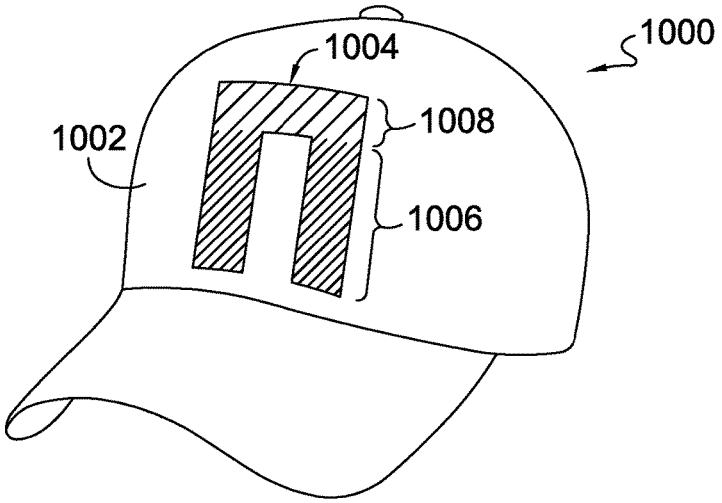

Turning now to FIG. 10, a headwear 1000 is illustrated in accordance with aspects of this disclosure, such as a hat. The headwear 1000 may be at least partially constructed with a reflective textile in accordance with one or more aspects described herein. The headwear 1000 may comprise a nonreflective portion 1002 and a reflective portion 1004. The reflective portion 1004 may have a single level of reflectivity (not explicitly depicted in FIG. 10 but still expressly described in other portions of this disclosure), or may have various levels of reflectivity, such as shown in FIG. 10. For example, the reflective portion 1004 may comprise a high reflective zone 1006 and a low reflective zone 1008, wherein the low reflective zone 1008 has a lower total reflectivity or coefficient of retroreflectivity than the high reflective zone 1006. Varied levels of reflectivity might result from various constructions. For example, a larger amount of reflective material may be applied to the surface of the headwear 1000 in the high reflective zone 1006 (as compared with the low reflective zone 1008); a larger amount of reflective material may be embedded in the high reflective zone 1006; or any and all combinations thereof. Additionally or alternatively, this may be the result of the reflective material being disposed at a depth, such as the first depth 626 of FIG. 5 from the first surface 610, greater in the low reflective zone 1008 than in the high reflective zone 1006. This may also be the result of using a first reflective material and the high reflective zone 1006 and a second reflective material in the low reflective zone 1008, wherein the second reflective material has a lower reflectivity and or coefficient of retro reflectivity than the first reflective material.

Figure 11:
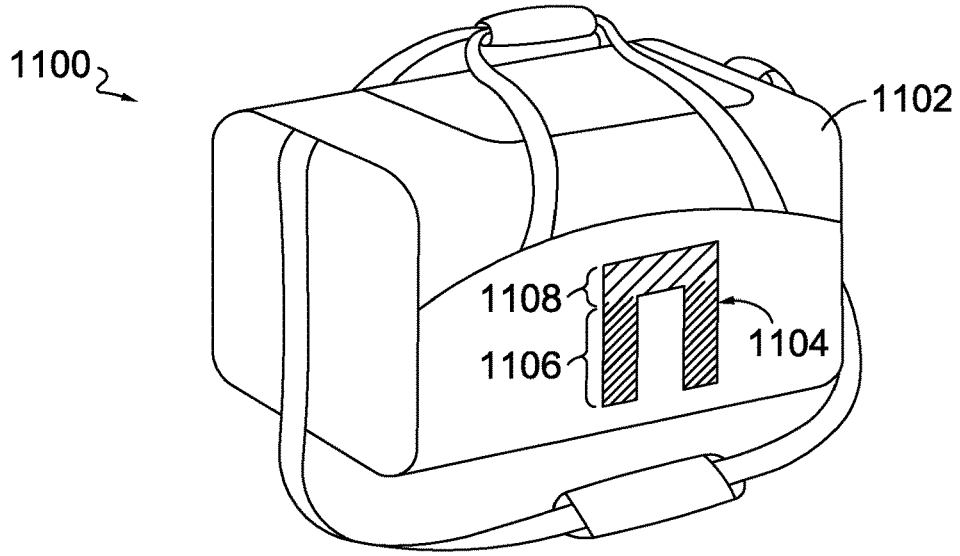

Turning now to FIG. 11, an article 1100 is illustrated in accordance with aspects of this disclosure, such as a user-borne bag. The article 1100 may be at least partially constructed with a reflective textile in accordance with one or more aspects described herein. The article 1100 may comprise a nonreflective portion 1102 and a reflective portion 1104. The reflective portion 1104 may have a single level of reflectivity (not explicitly depicted in FIG. 11 but still expressly described in other portions of this disclosure), or may have various levels of reflectivity, such as shown in FIG. 11. For example, the reflective portion 1104 may comprise a high reflective zone 1106 and a low reflective zone 1108, wherein the low reflective zone 1108 has a lower total reflectivity or coefficient of retroreflectivity than the high reflective zone 1106. Varied levels of reflectivity might result from various constructions. For example, a larger amount of reflective material may be applied to the surface of the article 1100 in the high reflective zone 1106 (as compared with the low reflective zone 1108); a larger amount of reflective material may be embedded in the high reflective zone 1106; or any and all combinations thereof. Additionally or alternatively, this may be the result of the reflective material being disposed at a depth, such as the first depth 626 of FIG. 5 from the first surface 610, greater in the low reflective zone 1108 than in the high reflective zone 1106. This may also be the result of using a first reflective material and the high reflective zone 1106 and a second reflective material in the low reflective zone 1108, wherein the second reflective material has a lower reflectivity and or coefficient of retro reflectivity than the first reflective material.

Figure 12:
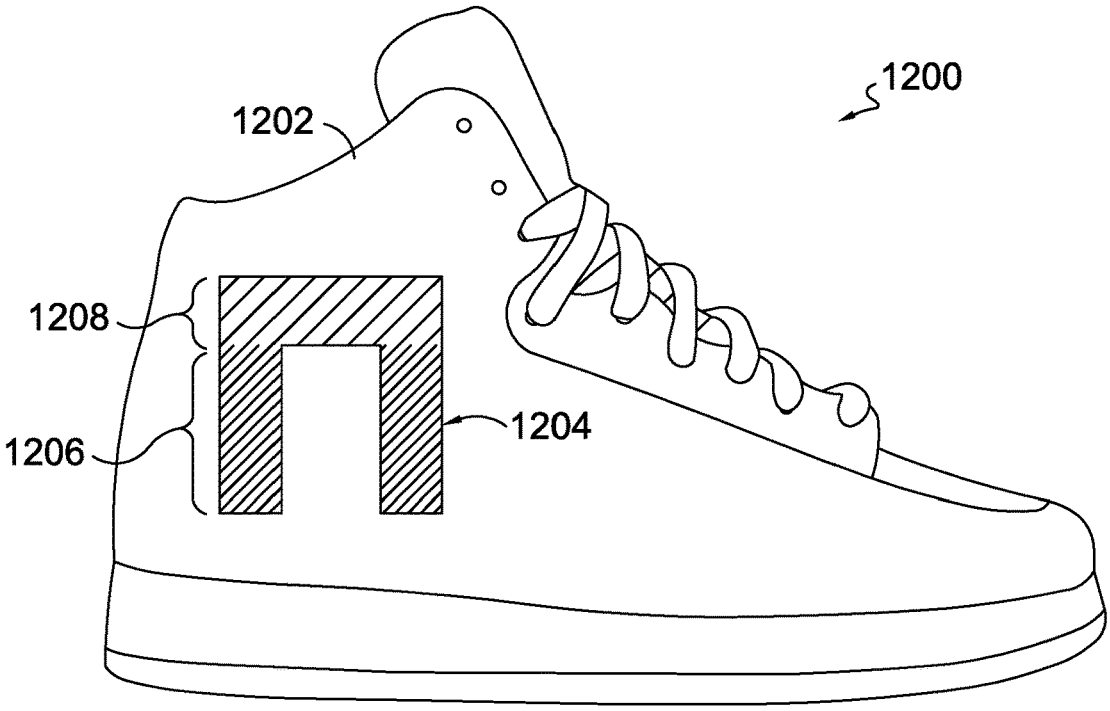

Turning now to FIG. 12, an upper for a footwear article 1200 is illustrated in accordance with aspects of this disclosure, such as an upper for a sneaker. The upper for a footwear article 1200 may be at least partially constructed with a reflective textile in accordance with one or more aspects described herein. The upper for a footwear article 1200 may comprise a nonreflective portion 1202 and a reflective portion 1204. The reflective portion 1204 may have a single level of reflectivity (not explicitly depicted in FIG. 12 but still expressly described in other portions of this disclosure), or may have various levels of reflectivity, such as shown in FIG. 12. For example, the reflective portion 1204 may comprise a high reflective zone 1206 and a low reflective zone 1208, wherein the low reflective zone 1208 has a lower total reflectivity or coefficient of retroreflectivity than the high reflective zone 1206. Varied levels of reflectivity might result from various constructions. For example, a larger amount of reflective material may be applied to the surface of the footwear article 1200 in the high reflective zone 1206 (as compared with the low reflective zone 1208); a larger amount of reflective material may be embedded in the high reflective zone 1206; or any and all combinations thereof. Additionally or alternatively, this may be the result of the reflective material being disposed at a depth, such as the first depth 626 of FIG. 5 from the first surface 610, greater in the low reflective zone 1208 than in the high reflective zone 1206. This may also be the result of using a first reflective material and the high reflective zone 1206 and a second reflective material in the low reflective zone 1208, wherein the second reflective material has a lower reflectivity and or coefficient of retro reflectivity than the first reflective material. In aspects, the upper may be said to have a total surface area and the reflective portion 1204 is at least 50% of the total surface area.

Figure 13:
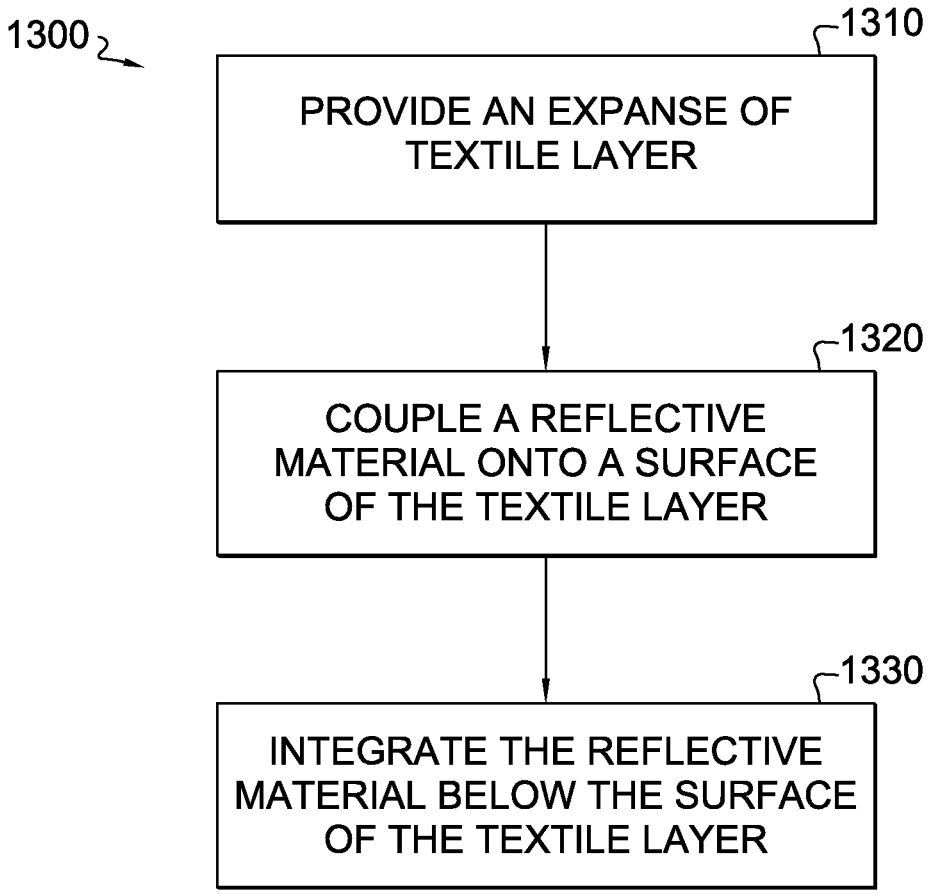
FIG. 13 depicts a flow diagram of an exemplary method of forming a textile having embedded reflective material in accordance with an aspect of this disclosure.
Figure 14A:
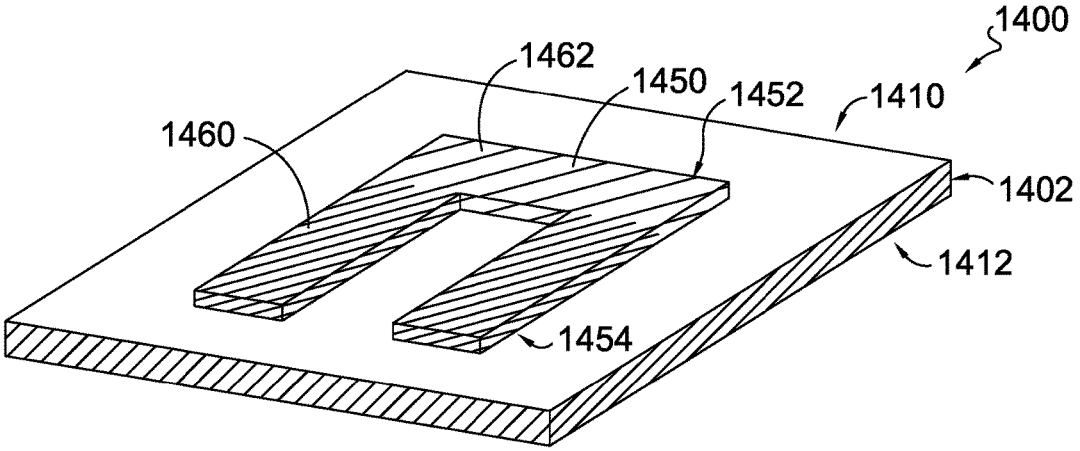
FIGS. 14A-14C each depict a respective stage include in a method of manufacturing a textile having a reflected material embedded within the textile in accordance with an aspect of this disclosure.
Figure 14B:
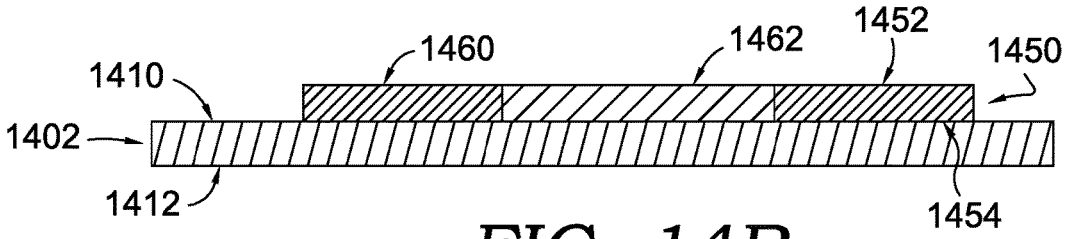
Figure 14C:
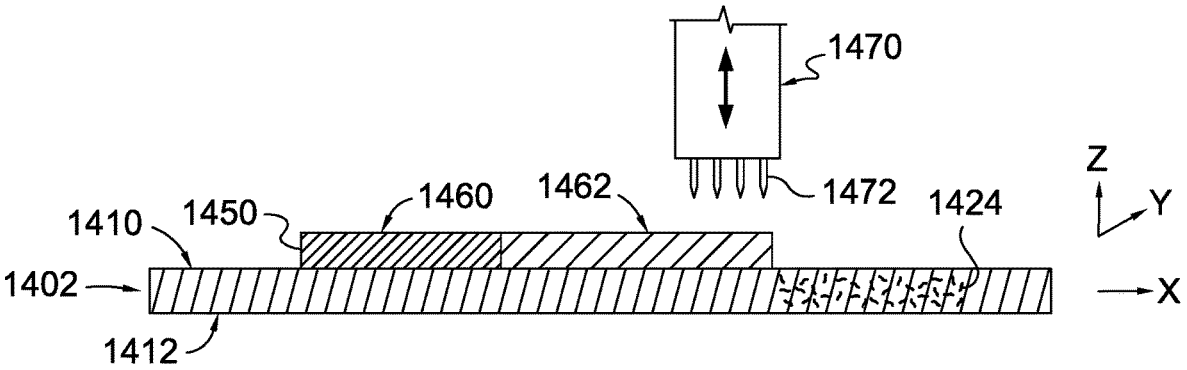

Turning now to FIG. 13, a flow chart is depicted for a method 1300 of making a reflective textile in accordance with aspects of this disclosure. In describing the method 1300, reference is also made to some of the other figures, including FIGS. 13A-13C to describe the steps of the method 1300. The method 1300 includes providing an expanse of a textile layer at step 1310. The textile layer may comprise any one or more features of the textile layer 102 of FIG. 1. The method 1300 also includes coupling a reflective material onto a surface of the textile layer at step 1320. The reflective material may comprise any one or more features of the reflective material 124 of FIG. 1. Specifically, the reflective material may be coupled to the surface of the textile layer using a screen printing process, and inkjet printing process, painting the reflective material on with a brush, or spray painting the reflective material, or any combination thereof. In addition, a reflective material may be coupled to the surface of the textile layer using hot melt adhesive or any other chemical bonding agent suitable for coupling the reflective material to the textile layer. An illustration of this step may be seen in FIGS. 13A-13B, which illustrate step 1320 in accordance with aspects herein. In step 1320, a reflective textile 1400 is formed from a textile layer 1402 and a reflective material 1450. The textile layer 1402 may be said to have a first surface 1410, a second surface 1412, and a fiber matrix extending between the first and second surfaces. The reflective material 1450 may be said to have a first surface 1452 and a second surface 1454. Further, in aspects the reflective material 1450 may be said to have a first zone 1460 and a second zone 1462. In such an aspect the first zone 1460 may have a more dense distribution of the reflective material than the second zone 1462 which may result in the corresponding portion of the first surface 1410 of the textile layer 1402 to be more reflective than that portion of the first surface 1410 embedded with the reflective material 1450 in the second zone 1462. The second surface 1454 of the reflective material 1450 is coupled to the first surface 1410 of the textile layer 1402.

Returning to FIG. 13, the method 1300 may integrate, disperse, or embed the reflective material below the surface of the textile layer at a step 1330. The reflective material may be integrated using a standard needle punching procedure used for creating felt nonwovens. In other aspects, the reflective material may be integrated below the surface of the textile layer using water jets or any other means of applying targeted pressure to the reflective material, causing it to be broken up into fragments and dispersed between the first and second surface of the textile layer to form the reflective textile. The reflective-material fragments that are integrated into the textile layer may have varying degrees of asymmetry, depending on the manner in which the fragments are dispersed into the textile layer. For example, a needle having a relatively symmetrically shaped tip might create at least some fragments that are relatively symmetrical. However, if the relatively symmetrically shaped tip is punched into positions that are least partially overlap with previous positions, then the fragments may be more asymmetrical. On the other hand, a pressurized fluid stream may create more asymmetrical fragments, as compared with the needle punch. Turning to FIG. 13C, an illustration of step 1330 is provided in accordance with an aspect of this disclosure. As the textile layer 1402 moves from left to right along next axis, an integrator 1470 actuates in an up-and-down manner forcing the reflective material 1450 to be broken up into fragments 1424 and dispersed between the first surface 1410 and the second surface 1412 of the textile layer 1402. In aspects, the reflective material 1450 is broken into asymmetric fragments, said asymmetric fragments being driven into the textile layer 1402 equal to at least 25% of the thickness of the textile layer 1402. In other aspects, the asymmetric fragments are driven into the textile layer 1402 at least 10% of the thickness of the textile layer 1402, or at least 5-50% of the thickness of the textile layer 1402. The integrator 1470 may be a device that uses a reciprocating tool or a fluid stream (e.g., air, liquid, etc.) to fragment the reflective-material and press the fragments into the textile layer, trapping them among the fiber or thread matrix of the textile layer. As depicted in FIG. 13C, the integrator 1470 may comprise needles 1472 used to perform a standard needle punching procedure used for creating felt nonwovens. Accordingly, the needle punching process pushes the film through the nonwoven fibers. The desired result occurs when the two layers are entangled to the point where the reflective material is no longer visible when viewed at an observation angle of 45° or more relative to an incident ray. In some aspects, the method 1300 may further comprise forming the reflective textile into a portion of a footwear article, a garment, or any other type of article such as those described herein Some aspects of this disclosure have been described with respect to the examples provided by FIGS. 1-13C. Additional aspects of the disclosure will now be described that may be related subject matter included in one or more claims of this application, or one or more related applications, but the claims are not limited to only the subject matter described in the below portions of this description. These additional aspects may include features illustrated by FIGS. 1-13C, features not illustrated by FIGS. 1-13C, and any combination thereof. When describing these additional aspects, reference may be made to elements depicted by FIGS. 1-13C for illustrative purposes.

As such, one aspect of the present disclosure includes a reflective textile comprising a non-woven textile layer comprising a first surface facing a first direction and a second surface facing a second direction opposite the first direction. The non-woven textile layer has a first zone and a second zone; and a first portion of reflective material is disposed as a plurality of asymmetrical fragments between the first surface and the second surface in the first zone of the non-woven textile layer. The first zone has a first coefficient of retroreflectivity and the second zone has a second coefficient of retroreflectivity, and the first coefficient of retroreflectivity is greater than the second coefficient of retroreflectivity.

Another aspect of the present disclosure includes an upper for a footwear article. The upper comprises a non-woven textile layer comprising a first surface facing away from a foot-receiving cavity when the upper is integrated into the footwear article and a second surface facing towards the foot-receiving cavity when the upper is integrated into the footwear article. The non-woven textile layer comprises a first zone and a second zone. A first portion of reflective material is disposed as a plurality of asymmetrical fragments between the first surface and the second surface in the first zone of the non-woven textile layer. The first zone has a first coefficient of retroreflectivity and the second zone has a second coefficient of retroreflectivity and the first coefficient of retroreflectivity is greater than the second coefficient of retroreflectivity An additional aspect of the present disclosure includes articles, excluding footwear, at least partially constructed from a reflective textile comprising a non-woven textile layer comprising a first surface facing a first direction and a second surface facing a second direction opposite the first direction. The non-woven textile layer has a first zone and a second zone; and a first portion of reflective material is disposed as a plurality of asymmetrical fragments between the first surface and the second surface in the first zone of the non-woven textile layer. The first zone has a first coefficient of retroreflectivity and the second zone has a second coefficient of retroreflectivity, and the first coefficient of retroreflectivity is greater than the second coefficient of retroreflectivity.

Yet another aspect of the present disclosure includes a method for manufacturing a reflective textile comprising providing an expanse of a non-woven textile. A reflective material is coupled onto a surface of the non-woven textile, the reflective material having a coefficient of reflectivity in a range of 10-300. At least a portion of the reflective material is integrated below the surface of the non-woven textile Subject matter set forth in this disclosure, and covered by at least some of the claims, may take various forms, such as a reflective textile, an article at least partially comprised of a reflective textile, and one or more methods of making each of these aspects or making any combination thereof.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

Clause 1. A reflective textile comprising: a non-woven textile layer comprising a first surface facing a first direction and a second surface facing a second direction opposite the first direction, the non-woven textile layer having a first zone and a second zone; and a first portion of reflective material disposed as a plurality of asymmetrical fragments between the first surface and the second surface in the first zone of the non-woven textile layer, wherein the first zone has a first coefficient of retroreflectivity and the second zone has a second coefficient of retroreflectivity, the first coefficient of retroreflectivity being greater than the second coefficient of retroreflectivity.

Clause 2. The textile of clause 1, wherein the non-woven textile layer has a thickness, and wherein at least a portion of the asymmetrical fragments are disposed at a depth below the first surface equal to at least 25% of the thickness.

Clause 3. The textile of any of clauses 1 and 2, wherein the first portion of the reflective material is suspended among fibers of the non-woven textile layer and a second portion is disposed as a layer on the first surface.

Clause 4. An upper for a footwear article, the upper comprising a non-woven textile layer comprising a first surface facing away from a foot-receiving cavity when the upper is integrated into the footwear article and a second surface facing towards the foot-receiving cavity when the upper is integrated into the footwear article, the non-woven textile layer comprising a first zone and a second zone; and a first portion of reflective material disposed as a plurality of asymmetrical fragments between the first surface and the second surface in the first zone of the non-woven textile layer, wherein the first zone has a first coefficient of retroreflectivity and a second zone has a second coefficient of retroreflectivity, the first coefficient of retroreflectivity being greater than the second coefficient of retroreflectivity.

Clause 5. The upper of clause 4, wherein the first zone comprises at least 50% of a total area of the first surface.

Clause 6. The upper of any of clauses 4 and 5, wherein the non-woven textile layer comprises asymmetrical distributions of the reflective material on the first surface in the first zone.

Clause 7. The upper of any of clauses 4-6, wherein an amount of reflective material disposed between the first surface and the second surface is greater than an amount of reflective material distributed on the first surface.

Clause 8. The upper of any of clauses 4-7, wherein the reflective material comprises thermoplastic polyurethane.

Clause 9. The upper of any of clauses 4-8, wherein the first coefficient of retroreflectivity is in a range of 10-300 cd/lux/$m^2$.

Clause 10. The upper of any of clauses 4-9, wherein, when an observation angle exceeds 45° relative to an incident ray emitted by a light source, the first zone is a same base color as the second zone.

Clause 11. The upper of any of clauses 4-10, wherein, when the observation angle is less than less 10° relative to the incident ray emitted by the light source, the reflective material imparts a sheen to the first zone.

Clause 12. The upper of any of clauses 4-11, wherein the upper further comprises an interior liner layer, which confronts, and is coupled at, the second surface.

Clause 13. The upper of clause 4-12, wherein the first zone corresponds to alphanumeric text.

Clause 14. A method of manufacturing a wearable article, the method comprising: providing an expanse of a non-woven textile; coupling a reflective material onto a surface of the non-woven textile, the reflective material having a coefficient of reflectivity in a range of 10-300; and integrating at least a portion of the reflective material below the surface of the non-woven textile.

Clause 15. The method of clause 14, wherein integrating comprises a needle-punching process, a water-jetting process, or any combination thereof.

Clause 16. The method of any of clauses 14-15, wherein coupling comprises a screen printing process, an ink-jet printing process, a brush painting process, a spray painting process, or any combination thereof.

Clause 17. The method of any of clauses 14-16, wherein the non-woven textile includes a thickness, and wherein integrating comprises driving asymmetrical fragments of the reflective material into the non-woven textile a distance equal to at least 25% of the thickness.

Clause 18. The method of any of clauses 14-17 further comprising, forming the non-woven textile into a portion of a footwear article.

Clause 19. The method of any of clauses 14-18, wherein the portion of the footwear article includes an upper.

Clause 20. The method of any of clauses 14-19 further comprising, forming the non-woven textile into a portion of an upper-body garment.

Clause 21. An article of clothing, the article comprising a non-woven textile layer comprising a first surface and a second surface opposite the first surface, the non-woven textile layer comprising a first zone and a second zone; and a first portion of reflective material disposed as a plurality of asymmetrical fragments between the first surface and the second surface in the first zone of the non-woven textile layer, wherein the first zone has a first coefficient of retroreflectivity and the second zone has a second coefficient of retroreflectivity, the first coefficient of retroreflectivity being greater than the second coefficient of retroreflectivity.

Clause 22. A footwear article, the footwear article comprising a non-woven textile layer comprising a first surface facing away from a foot-receiving cavity when the upper is integrated into the footwear article and a second surface facing towards the foot-receiving cavity when the upper is integrated into the footwear article, the non-woven textile layer comprising a first zone and a second zone; and a first portion of reflective material disposed as a plurality of asymmetrical fragments between the first surface and the second surface in the first zone of the non-woven textile layer, wherein the first zone has a first coefficient of retroreflectivity and the second zone has a second coefficient of retroreflectivity, the first coefficient of retroreflectivity being greater than the second coefficient of retroreflectivity.

Clause 23. A footwear article comprising the textile of any of clauses 1-3.

Clause 24. The footwear article of clause 23 further comprising, an interior liner coupled to a surface of the reflective textile facing towards a foot-receiving cavity of the footwear article.

Clause 25. An upper-body garment comprising the textile of any of clauses 1-3.

Clause 26. A lower-body garment comprising the textile of any of clauses 1-3.

Clause 27. A bag comprising the textile of any of clauses 1-3.

Clause 28. The method of any of clause 14-17 further comprising, forming the non-woven textile into a portion of a bag.

From the foregoing, it will be seen that subject matter described in this disclosure is adapted to attain the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible alternative versions may be made of the subject matter described herein, without departing from the scope of this disclosure, it is to be understood that all matter herein set forth or shown in the accompanying drawings is to be interpreted as illustrative and not in a limiting sense.

What is claimed is:

1. A reflective textile comprising:

a non-woven textile layer comprising a first surface facing a first direction and a second surface facing a second direction opposite the first direction, the non-woven textile layer having a first zone and a second zone; wherein the non-woven textile layer has a thickness, a first portion of reflective material disposed as a plurality of asymmetrical fragments suspended among fibers of the non-woven textile layer between the first surface and the second surface in the first zone of the non-woven textile layer, wherein the non-woven textile layer has a thickness, and wherein a first amount of the first portion of reflective material is suspended at a depth below the first surface equal to 10% of the thickness, a second amount of the first portion of reflective material is suspended at a depth below the first surface equal to 50% of the thickness, and a third amount of the first portion of reflective material is suspended in a range of depths between the first amount and the second amount;

a second portion of reflective material disposed on the first surface in the first zone of the non-woven textile layer, wherein the first zone has a first coefficient of retro reflectivity and the second zone has a second coefficient of retro reflectivity, the first coefficient of retro reflectivity being greater than the second coefficient of retro reflectivity;

and wherein at least a portion of the asymmetrical fragments are in a range of depths below the first surface equal to 10%-50% of the thickness.

2. The textile of claim 1, wherein the non-woven textile layer has a thickness, and wherein at least a portion of the asymmetrical fragments are disposed at a depth below the first surface equal to at least 25% of the thickness.

3. An upper for a footwear article, the upper comprising:

a non-woven textile layer comprising a first surface facing away from a foot-receiving cavity when the upper is integrated into the footwear article and a second surface facing towards the foot-receiving cavity when the upper is integrated into the footwear article, the non-woven textile layer comprising a first zone and a second zone;

a first portion of reflective material disposed as a plurality of asymmetrical fragments between the first surface and the second surface in the first zone of the non-woven textile layer, wherein the non-woven textile layer has a thickness, and wherein a first amount of the first portion of reflective material is suspended at a depth below the first surface equal to 10% of the thickness, a second amount of the first portion of reflective material is suspended at a depth below the first surface equal to 50% of the thickness, and a third amount of the first portion of reflective material is suspended in a range of depths between the first amount and the second amount;

a second portion of reflective material disposed on the first surface in the first zone of the non-woven textile layer; and wherein the first zone has a first coefficient of retro reflectivity and the second zone has a second coefficient of retro reflectivity, the first coefficient of retro reflectivity being greater than the second coefficient of retro reflectivity.

4. The upper of claim 3, wherein the first zone comprises at least 50% of a total area of the first surface.

5. The upper of claim 3, wherein an amount of reflective material disposed between the first surface and the second surface is greater than an amount of reflective material distributed on the first surface.

6. The upper of claim 3, wherein the reflective material comprises thermoplastic polyurethane.

7. The upper of claim 6, wherein the first coefficient of retro reflectivity is in a range of 10-300 cd/lux/$m^2$.

8. The upper of claim 3, wherein, when an observation angle exceeds 45° relative to an incident ray emitted by a light source, the first zone is a same base color as the second zone.

9. The upper of claim 8, wherein, when the observation angle is less than less 10° relative to the incident ray emitted by the light source, the reflective material imparts a sheen to the first zone.

10. The upper of claim 3, wherein the upper further comprises an interior liner layer, which confronts, and is coupled at, the second surface.

11. The upper of claim 3, wherein the first zone corresponds to alphanumeric text.

* * * * *